US008516860B2

(12) United States Patent
Persson et al.

(10) Patent No.: US 8,516,860 B2
(45) Date of Patent: Aug. 27, 2013

(54) WASHING MACHINE AND DRYER

(75) Inventors: Leif Persson, Lidhult (SE); Anders Brun, Ljungby (SE); Jorgen Martinsson, Ljungby (SE); Jonny Persson, Ljungby (SE); Johnny Olsson, Ljungby (SE)

(73) Assignee: Aktiebolaget Electrolux, Stockholm (SE)

( * ) Notice: Subject to any disclaimer, the term of this patent is extended or adjusted under 35 U.S.C. 154(b) by 729 days.

(21) Appl. No.: 12/663,313

(22) PCT Filed: Jun. 2, 2008

(86) PCT No.: PCT/EP2008/004368

§ 371 (c)(1), (2), (4) Date: May 27, 2010

(87) PCT Pub. No.: WO2008/148508

PCT Pub. Date: Dec. 11, 2008

(65) Prior Publication Data

US 2010/0229607 A1 Sep. 16, 2010

(30) Foreign Application Priority Data

Jun. 7, 2007 (SE) ..... 0701417

(51) Int. Cl.
*D06F 29/00* (2006.01)
*D06F 35/00* (2006.01)

(52) U.S. Cl.
USPC ..... 68/19.2; 68/19; 68/20; 68/3 R

(58) Field of Classification Search
USPC ..... 68/19
See application file for complete search history.

(56) References Cited

U.S. PATENT DOCUMENTS

| | | | |
|---|---|---|---|
| 2,910,854 | A | 11/1959 | Hughes |
| 3,856,036 | A | 12/1974 | Drews et al. |
| 4,154,003 | A | 5/1979 | Muller |

(Continued)

FOREIGN PATENT DOCUMENTS

| | | |
|---|---|---|
| EP | 0789105 | 8/1997 |
| EP | 1544345 | 6/2005 |
| GB | 254985 | 7/1926 |

OTHER PUBLICATIONS

International Search Report for PCT/EP2008/004368, dated Sep. 22, 2008, 2 pages.

*Primary Examiner* — Michael Kornakov
*Assistant Examiner* — Jason Ko
(74) *Attorney, Agent, or Firm* — Pearne & Gordon LLP

(57) ABSTRACT

The present disclosure relates to a washing machine with a drying function, capable of performing a washing program and a drying program. The machine comprises a cabinet (1), a tub (9) in the cabinet and a door (3), through which access to the tub interior can be achieved, and further an air evacuation chamber (37) which comprises an upper section (59) and a lower section (57), wherein the upper section is connected to the tub in order to allow an air flow from the tub to the upper section, and the upper section is connected to the lower section at a connection point which is higher than the maximum water level during the washing program, such that air can flow to the lower section during the drying program while water is prevented from flowing from the tub to the lower section during the washing program. This allows the lower part to contain parts of the drying system that are to be kept dry, which allows a more compact machine to be built.

13 Claims, 4 Drawing Sheets

(56) References Cited

U.S. PATENT DOCUMENTS 6,360,567 B1 * 3/2002 Lu ..... 68/12.05
6,954,995 B2 * 10/2005 Kitamura et al. ..... 34/597
2004/0221474 A1 11/2004 Slutsky et al.
2006/0277690 A1 * 12/2006 Pyo et al. ..... 8/149.2

* cited by examiner

WASHING MACHINE AND DRYER

TECHNICAL FIELD

The present disclosure generally relates to a washing machine with a drying function, capable of performing a washing program and a drying program.

BACKGROUND ART

Machines of the initially mentioned kind are well known, see e.g. EP, 1752575, A1.

The present disclosure generally seeks to improve machines of this kind.

SUMMARY

This object is achieved by means of a washing machine with a drying function, capable of performing a washing program and a drying program, comprising a cabinet, a tub in the cabinet and a door, through which access to the tub interior can be achieved, The machine comprises an air evacuation chamber which comprises an upper section and a lower section, wherein the upper section is connected to the tub in order to allow an air flow from the tub to the upper section, and the upper section is connected to the lower section at a connection point which is higher than the maximum water level during the washing program, such that air can flow to the lower section during the drying program while water is prevented from flowing from the tub to the lower section during the washing program.

This allows a machine to be built where sections of the drying system may be place below the maximum water level. This allows a very compact machine to be built. Additionally, only a small fraction of the evacuation chamber need be filled with water during the washing program, which saves water and, if the water is heated, energy.

Further, with this arrangement, the air can be let out at the front of the machine where the door is placed. This involves an advantage as the air is then cooled somewhat by the wet laundry upstream. As compared to a machine where hot air is instead injected at the door, which may comprise a glass window, the door will be a lot cooler.

The evacuation chamber may be arranged as an annular chamber, surrounding the door, and may be defined between a cylindrical wall of the tub, a cylindrical collar plate surrounding the door, an inner front wall and an outer front wall.

In such a machine, the evacuation chamber may be divided into the upper section and the lower section by means of side plates attached to and extending sideways and upwards from the collar plate and openings may be provided in the collar plate over the location where the side plates are attached.

A lint filter unit and/or a blower may be connected to the lower section and may be located lower than the maximum water level during the washing program.

The washing machine may comprise two water level sensors to provide additional over-filling protection.

DETAILED DESCRIPTION

Figure 1:
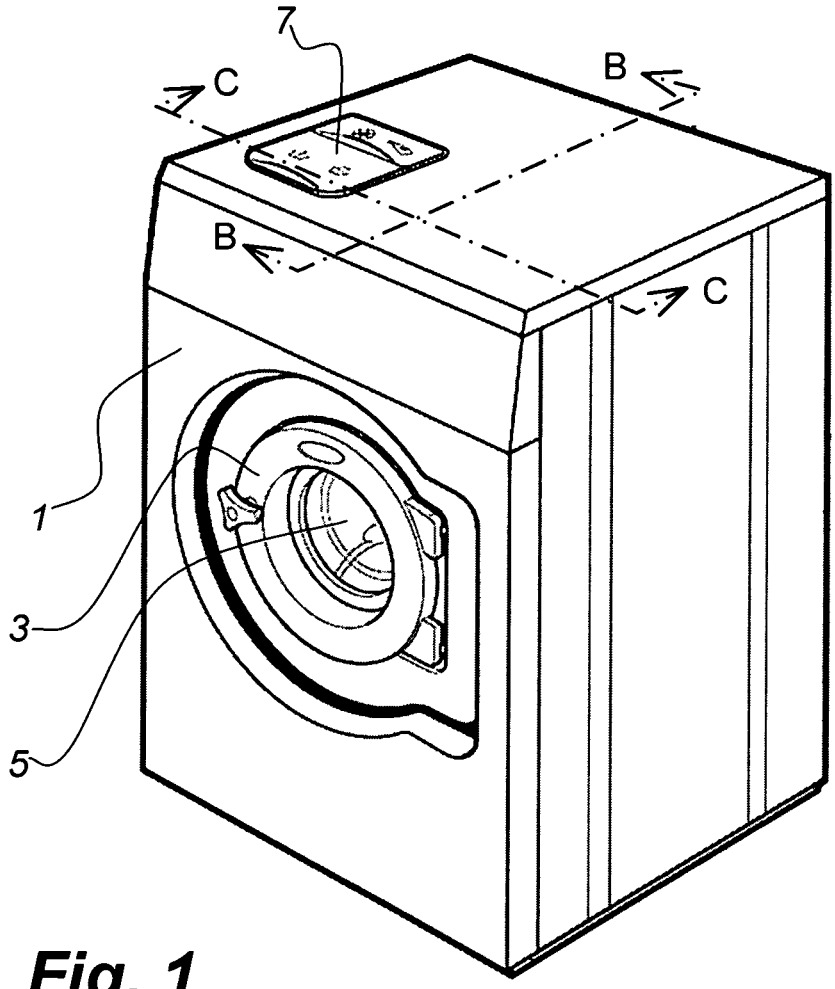
FIG. 1 shows a perspective view of a washing machine with a drying function.

FIG. 1 shows a perspective view of a washing machine with a drying function. Generally, the washing machine comprises a cabinet 1, having a door 3 in its front surface, which allows access to the interior of the cabinet 1 for feeding laundry into the cabinet and removing cleaned laundry from it. It should be noted that some features of the present disclosure are relevant also for washing machines which are instead provided with a door in the cabinet top surface. A glass window 5 in the door 3 allows the user to visually verify the washing process during use.

The washing machine is provided with a detergent compartment 7 in its top. However other suitable locations for the detergent compartment exist.

Although in the following a washing machine with a drying function will be disclosed, it should be noted that some features of the present disclosure are relevant also for dryers that do not have washing functions, and are used to dry laundry that has been washed in a dedicated washing machine.

Figure 2:
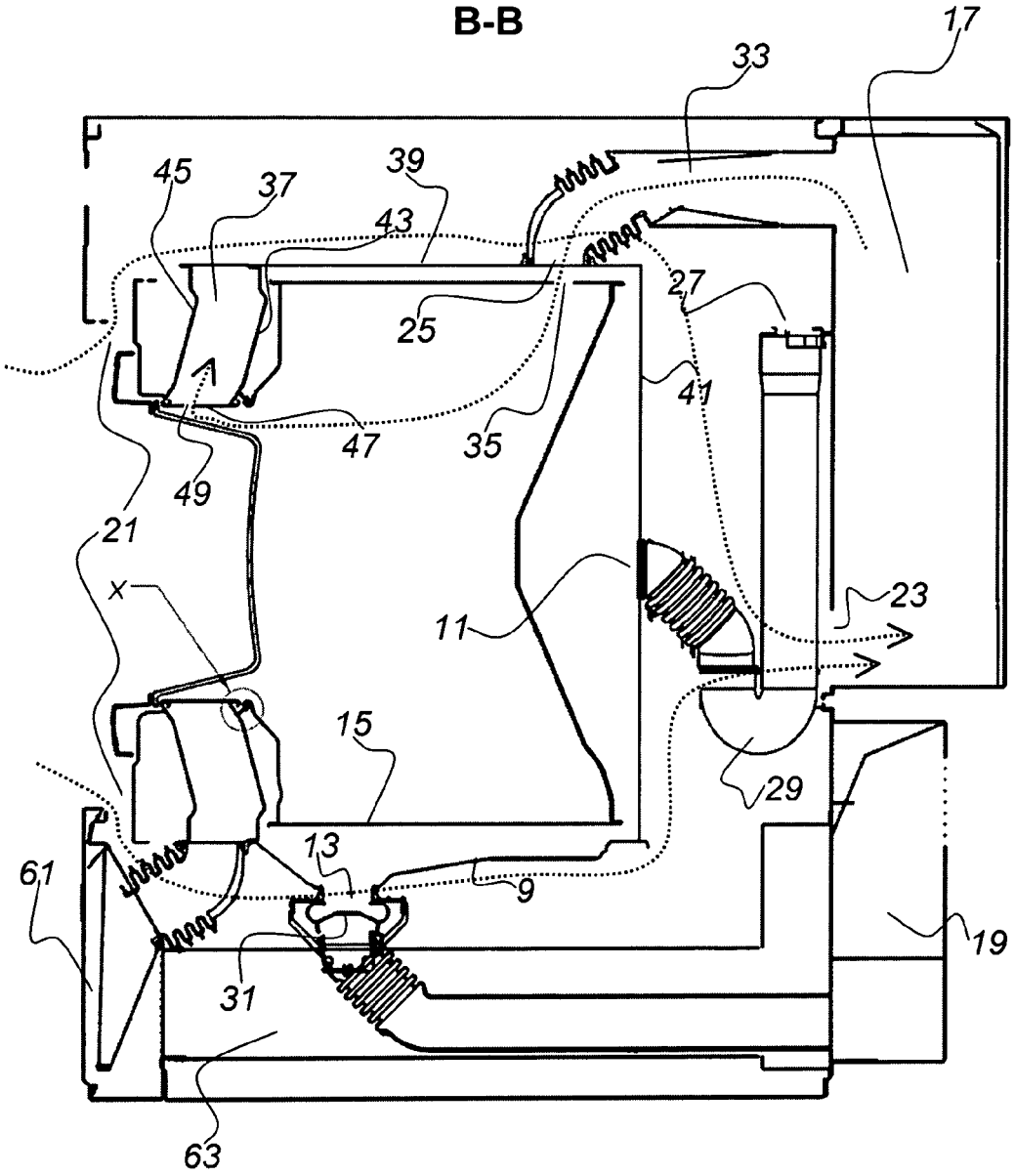
FIG. 2 illustrates a cross-section along the line B-B in the washing machine in FIG. 1.

FIG. 2 illustrates a cross-section along the line B-B in the washing machine in FIG. 1. A tub 9 is placed in the interior of the cabinet 1. When used in a washing phase, the tub is first partly filled with optionally heated, detergent-mixed water through a water inlet 11. The water is subsequently removed through a drain 13 in the lower part of the tub 9. In one or more rinsing cycles, the tub 9 is then partially filled with water to remove detergents and dirt from the laundry.

The laundry is placed in a rotatable drum 15, or basket in the tub 9. During the washing phase and the rinsing cycles of a washing program, the drum 15 is rotated by means of a motor (not shown) in order to mechanically work the laundry, such that the washing and rinsing effects are enhanced. As is well known per se, the drum 15 may further spin-dry the laundry each time water is evacuated from the tub 9.

When the washing program is finished, the laundry may be dried in a drying program by forcing an air stream through the wet laundry, preferably while rotating the drum 15. The air stream may be substantially heated by an air heating device 17 before it is forced through the laundry. The air heating device may be electric or use gas (e.g. LPG) as a heating source, in which case the heated air stream may to some extent be mixed with exhaust gases. Optionally, the washing machine may be provided with a condenser (not shown) for the subsequent removal of water from the air stream.

During the drying program, a blower 19 generates a negative pressure (i.e. a pressure lower than the ambient air pressure) in the interior of the machine, which will transport air through the machine in a predetermined path, as will now be described. It will first be described how ambient air is moved to the air heating device 17. The air heating device 17 is located in the rear part of the machine. This means that, as seen from the front (where the door is placed), the heating device is placed behind the tub 9. Ambient air is let into the machine through front air inlets 21 which are located in the front of the machine. In the illustrated case, the inlets are arranged as a single ring-shaped inlet surrounding the door 3. However, other configurations are possible. For instance, it is possible to provide a plurality of smaller inlets around the periphery of the door 3 or even to provide a single inlet e.g. above the door 3. It should be noted though, that it is advantageous to provide front air inlets 21 that allow the air to enter the machine at a plurality of locations around the periphery of the door 3 of the cabinet 1, as will be described.

The heating device inlet 23 is placed behind the tub 9 as seen from the front of the machine. This means that, when ambient air is sucked into the machine through the front air inlets 21 and is transported to the heating device inlet 23, the air will, as illustrated by means of dotted arrows in FIG. 2, pass close to the tub 9, which may have a cylindrical shape. As the tub 9 is relatively hot during the drying program (as compared to ambient conditions), the air will be pre-heated by the tub 9 before entering the air heating device 17. Thus, a heat exchanger function is provided by the tub 9 thanks to the chosen locations of the front air inlets 21 and the heating device inlet 23. Thereby, less energy may be consumed in the air heating device 17 to provide a given quantity of produced hot air with a given temperature. Over the drying program energy is thus saved. Additionally, the air heating device 17 may be chosen to provide a lower heating power capacity. A less expensive air heating device 17 may thus be provided while maintaining a desired heating effect. If the front air inlets 21 allow the air to enter the machine at a plurality of locations around the periphery of the door 3, a great part of the tub's 9 periphery will be used for pre-heating purposes, which enhances the effect. It should be noted that this feature may also be used in drying machines that are not provided as a combined washing machine and dryer.

After passing through the air heating device 17 and being heated, the hot air enters the tub as illustrated by a dotted arrow in FIG. 2. It has been found that some air can also enter the tub through the water inlet 11. This is due to the fact that the water inlet must, in most countries, be connected to an anti-siphoning device 27 to avoid the washing machine contaminating the water supply system in case of malfunction of the machine or falling pressure in the supply system.

The anti-siphoning device 27 has a connection to air. When cold air enters the tub 9 in this way, due to the negative pressure in the machine, the drying effect of the machine is reduced. It has been found that this effect can be reduced or eliminated by placing a water trap 29 between the water inlet 11 of the tub 9 and the anti-siphoning device 27. The water trap 29 may generally comprise e.g. a J-, U-, or S-shaped tube. It should be noted that this effect is provided also if the water inlet has another connection to ambient air than an anti-siphoning device. It should further be noted that the water trap 29 is useful also if the air flow in the machine is generated by producing a positive pressure in the machine. In this case, the water trap helps preventing the escape of hot air from the tub 9, which lowers the energy consumption. Additionally, the water trap improves the mixing of detergents in the water. It should be noted that, while this feature is particularly suitable in combination with other features disclosed herein, the provision of a water trap in this way may improve almost any combined washing machine-dryer.

To provide an additional energy saving effect, the drain valve 31 of the drain 13 is closed during the drying program, This avoids the entering of cold air into the tub 9 through the drain 13 (or the escape of hot air in case of a positive pressure in the machine). Additionally, any presence of sewage smell in the dried laundry may be avoided in this way. The machine thus comprises means, usually software-implemented, for closing the drain valve 31 during the drying program. It should be noted that, while this feature is particularly suitable in combination with other features disclosed herein, the provision of a drain valve which is closed in this way may improve almost any combined washing machine-dryer.

Between the air heating device 17 and the tub air inlet 25, a steam protection device 33 is provided, which protects the air heating device 17 from steam and water drops which may be ejected from the tub 9. Steam may typically be during high-temperature washing programs, and drops may be ejected, e.g. during centrifugation (spin-drying). This makes the working life length of the air heating device 17 longer, as it will to a lesser extent be subjected to corrosion and/or the risk of short-circuits in case the air heating device is electric. The steam protection device will be described in more detail later.

When the hot air has been moved into the tub 9 it is fed into the rotatable drum 15 through a plurality of openings 35 (only one shown). The openings 35 in the drum 15 may be provided in its outer periphery and may, during centrifugation in the washing program, be used to evacuate water in the opposite direction. The laundry in the drum 15 is subjected to the hot air, which takes up water from the laundry. The hot air is then sucked out into an air evacuation chamber 37, which is placed in the front part of the machine. The front part of the machine will now be described in greater detail with reference to both FIGS. 2 and 4.

The tub 9 is generally defined by a cylindrical wall 39, a rear wall 41, and an inner front wall 43. The cylindrical wall 39 is extended in front of the inner front wall 43, and defines, together with the inner front wall 43, an outer front wall 45 and a collar plate 47, the air evacuation chamber 37. In the illustrated machine, the air evacuation chamber 37 is ring-shaped and surrounds the door 3. The air in the drum 15 is sucked out from there through openings 49 in the collar plate 47.

The collar plate 47 may optionally, as illustrated in FIG. 2 surround the glass window 5 in the door 3. This provides air evacuation means in the close vicinity of the glass window 5, which provides an additional advantage. When the air passes the glass window 5 it has been cooled to some extent by taking up moisture from the wet laundry. This means that the glass window 5 will be heated to a much lesser extent as compared to a conventional machine where hot air, from an air heating device, is forced into a drum in the close vicinity of a glass window. The user of the machine is therefore exposed to a much smaller risk of burn injuries resulting from touching the glass window 5.

In order to make sure that the air does not, to any greater extent flow from the tub air inlet 25, between the drum 15 on the one hand and the cylindrical wall 39 and the inner front wall 37 on the other and then into the openings in the collar plate 47, a sealing ring 51 is provided between the drum 15 and the inner front wall 43. By means of the sealing ring 51 a greater part of the air flow is forced into the drum where it is made useful for drying the laundry. The sealing ring 51 will be described in greater detail later.

Figure 4:
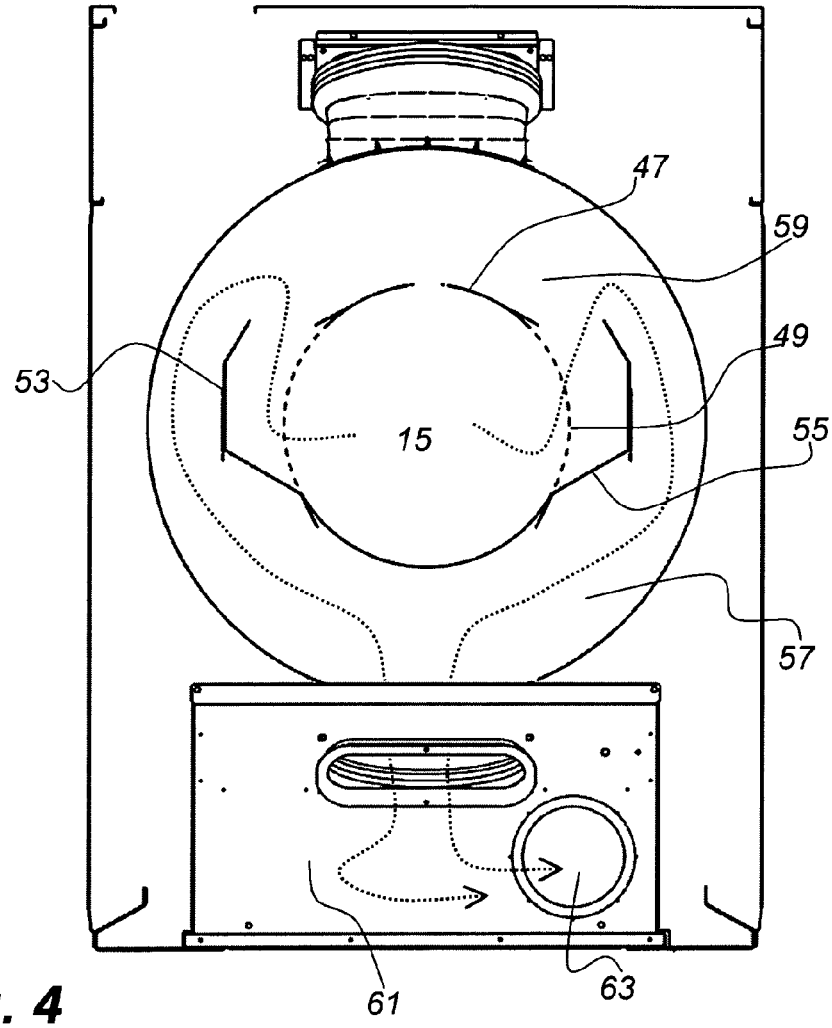
FIG. 4 illustrates a cross-section along the line C-C in the washing machine in FIG. 1.

Most of the air thus passes through the drum 15 and then flows through openings 49 in the collar plate 47 into the evacuation chamber, as is more easily seen in FIG. 4.

Side plates 53, 55 are provided which extend sideways and upwards from the lower part of the collar plate 47. Generally, the side plates 53, 55 divide evacuation chamber 37 into a lower section 57 and an upper section 59, which are interconnected over the maximum water level during the washing program. The openings 49 in the collar plate 47 connect the drum 15 with the upper section 59 of the evacuation chamber 37.

As illustrated in FIG. 4, the air thus flows from the drum and into the upper part of the evacuation chamber 37 as illustrated by the dotted arrows. As the upper 59 and lower 57 sections are inter-connected, the air may then flow into the lower section 57 an then into a filter device 61, which is used to remove lint from the air stream. The air then continues into a blower pipe 63 which is connected to the blower (cf. 19, FIG. 1) which generates the air stream in the machine.

When, during the washing program, the tub 9 is partially filled with water, the water never reaches the point where the upper 59 and lower 57 sections are inter-connected, i.e. to the uppermost edges of the side plates 53, 55. The water is therefore not permitted to flow into the lower section 57.

The arrangement with an evacuation chamber 37 having an upper section 59 and a lower section 57 which are inter-connected above the maximum water level is advantageous for several reasons. The evacuation chamber 37 allows air to leave the drum 15 at the front of the machine and to continue to the lower parts of the machine, while not allowing water to follow the same path during the washing program. This makes it possible to place e.g. the filter device 61 and the blower 9, which are to remain dry during the washing program, below the water level during the washing program. As the lower part of the machine can be used to contain these parts, the machine can be made a lot more compact.

Additionally, as the water can only fill a minor part of the evacuation chamber 37 during the washing program, a lot of water is saved as compared to a conceivable machine where an evacuation chamber is not divided into sections and the air is removed from the chamber at the top thereof.

In the illustrated case, the evacuation chamber 37 has a circular shape surrounding the door 3 of the machine. While this efficiently uses the space in the machine front, other shapes are conceivable, as long as the machine has an upper section and a lower section which are inter-connected at a point higher than the maximum water level, such that water cannot flow to the lower section during the washing program. Additionally, air flow from the upper section to the lower section during the drying program should be allowed and the drum or tub should be connected to the upper section. Note that the lower section may upwards extend as high or higher than the upper section, however the lower section will extend further towards the floor on which the machine stands as compared to the upper section.

Figure 7:
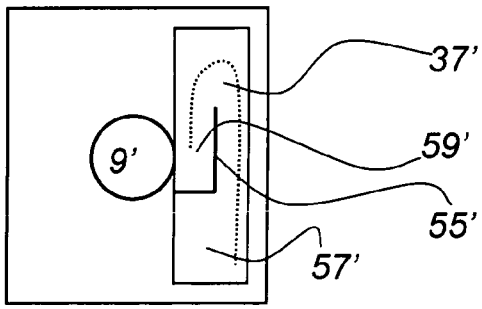
FIG. 7 illustrates schematically an alternative to the cross-section of FIG. 4.

One alternative example is, very schematically, illustrated in FIG. 7, which shows a cross-section similar to the cross-section in FIG. 4. In this case, the air evacuation chamber 37' has a rectangular cross section and is placed beside the door of the machine. The chamber is divided by a plate 55' into a lower section 57' and an upper section 59'. The upper section is connected to the tub 9'. As the skilled person realizes from FIG. 7, the evacuation chamber may also be provided by a tube which is bent in an upside-down J-form (illustrated as a dotted line), where the bent portion of the J marks the transition between the lower and upper portions.

The washing machine may optionally comprise two water level sensors to provide additional over-filling protection. The activation of one sensor, indicating that the water level due to a malfunction approaches the level where water can flow into the lower section of the air evacuation chamber, may cause the drain valve of the machine to open.

Figure 3A:
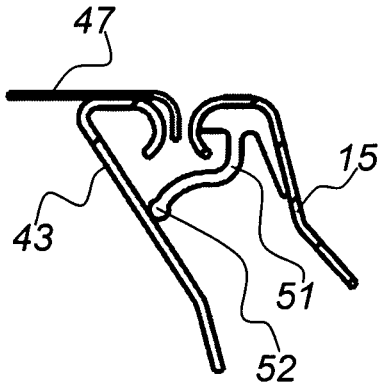
FIGS. 3*a* and 3*b* illustrate a cross-section through a sealing ring in two different states.
Figure 3B:
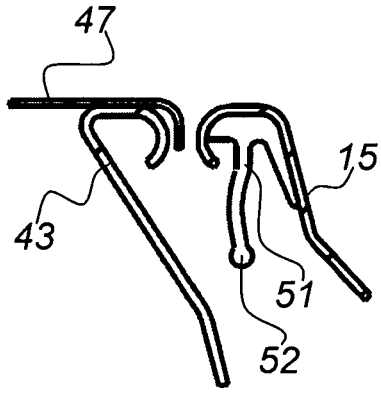

FIGS. 3*a* and 3*b* illustrate a cross-section through the aforementioned sealing ring 51 in two different states. FIG. 3*a* (c.f. detail X of FIG. 2) illustrates the sealing ring in the normal state, and FIG. 3*b* illustrates the sealing ring in the centrifugation (spin-drying) state. As illustrated in FIG. 3*a*, the sealing ring is attached to the rotatable drum 15. The cross-section of the ring 51 extends from the drum 51 towards the inner front wall 43 and a free end 52 touches the latter at a part thereof which is close to the connection with the collar plate 47. The sealing ring 51 thus provides a seal between the drum 15 and the inner front wall 43 of the tub 9, to substantially reduce the air flow between these parts.

The cross-section of the ring extends from the drum towards the inner front wall 43 in a direction which is inclined from a direction perpendicular to the axis of rotation of the drum 15. When, during centrifugation in the washing program, the sealing ring 51 is subjected to centrifugal forces, such that the free end 52 is forced towards said perpendicular direction such that is does no longer touch the inner front wall 43. Thereby the friction between the drum and the inner front wall is reduced. During centrifugation, the sealing function is not needed. The impact of the centrifugal forces on the free end may be enhanced by, as illustrated, providing a free end with a bulbous cross-section. It should be noted that, while this feature is particularly suitable in combination with other features disclosed herein, the provision of such a sealing ring may improve almost any combined washing machine-dryer.

Figure 5A:
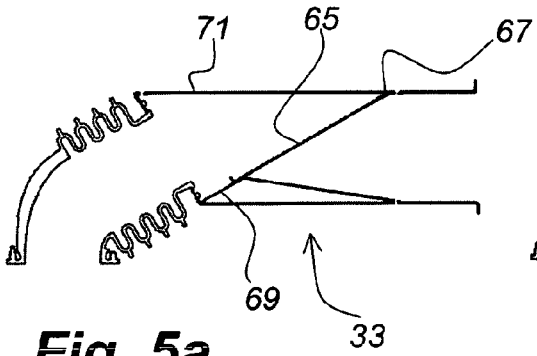
FIGS. 5*a* and 5*b* illustrate a cross-section through a steam protection device in two different states.
Figure 5B:
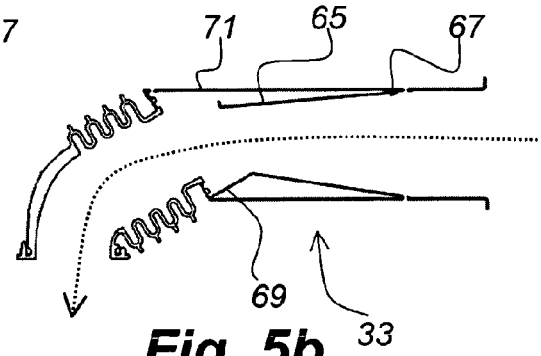

FIGS. 5*a* and 5*b* illustrate a cross-section through the aforementioned steam protection device 33 in two different states. FIG. 5*a* shows the steam protection device during the washing program and FIG. 5*b* during the drying program.

The steam protection device 33 comprises a shutter 65 which is attached by means of a hinge 67 in the interior of a tube 71. During the washing program, as illustrated in FIG. 5*a*, the shutter 65 is closed and rests against a support surface 69, which is inclined towards the tub of the machine. In this state, the shutter seals the tube 71 and prevents a flow of steam in the reverse direction, towards the air heating device (cf. 17, FIG. 2). In this state further, the shutter 65 exposes a surface in the direction of the tub, which collects any water drops coming from the tub and protects the air heating device from the drops. The surface of the shutter 65 in this state is inclined towards the tub, such that the collected drops and condensation flows back towards the tub.

When the drying program begins and the blower of the machine is turned on, the generated air flow, illustrated by a dotted arrow in FIG. 5*b*, opens the shutter 65 which pivots at the hinge 67. The support surface 69 below the shutter 65 makes sure that no remaining water flows in the opposite direction, towards the air heating device.

It should be noted that, while this feature may be particularly suitable in combination with other features disclosed herein, the provision of a steam protection device in this way may improve almost any combined washing machine-dryer.

Figure 6A:
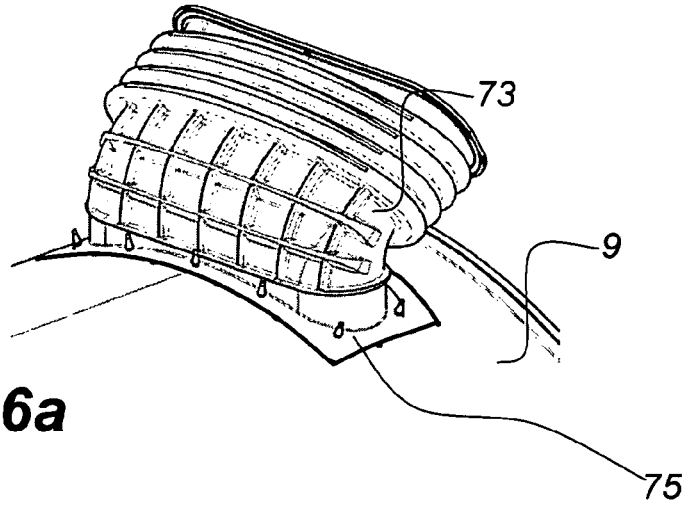
FIGS. 6*a* and 6*b* illustrate a the mounting of a tub air inlet tube to a tub.
Figure 6B:
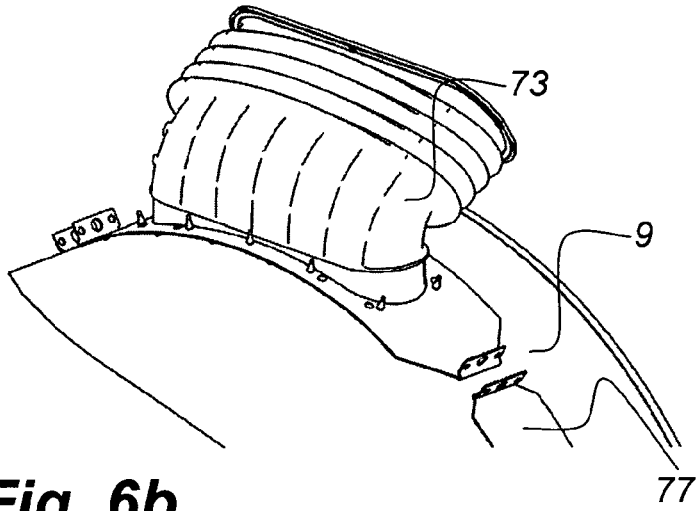

FIGS. 6*a* and 6*b* illustrate the mounting of a tub air inlet tube 73 to a tub 9. The tube 73 may be made of a flexible material, such as rubber, and comprises a flange 75, which may have a form corresponding to the cylindrical shape of the tub 9. When the tub air inlet tube 73 is mounted, it is placed on the tub at the location thereof where the tub air inlet (cf. 25, FIG. 2) is located, such that the flange surrounds the tub air inlet. A strap 77 having an opening, which is smaller than the flange 75 but through which the rest of the inlet tube 73 can pass, is used. The strap 77 is wrapped around the cylindrical tub 9 and is tightly fastened thereto. Thereby, the flange 75 is pressed against the tub 9, such that a tight connection between the inlet tube 73 and the tub interior is provided. This provides a simpler and more reliable means for connection as compared e.g. to welding a tube to the tub. It should be noted that, while this feature is particularly suitable in combination with other features disclosed herein, the provision of an inlet tube of this kind may improve almost any dryer.

The invention is not restricted to the described embodiments, and may be varied and altered within the scope of the appended claims.

The invention claimed is:

1. A washing machine with a drying function, capable of performing a washing program and a drying program, comprising a cabinet (1), a tub (9; 9') in the cabinet and a door (3), through which access to the tub interior can be achieved, characterized by an air evacuation chamber (37; 37') which comprises an upper section (59; 59') and a lower section (57; 57'), wherein the upper section (59; 59') is connected to the tub (9; 9') by openings (49) in order to allow an air flow directly from the tub (9; 9') to the upper section (59; 59'), and the upper section (59; 59') is connected to the lower section (57; 57') at a connection point which is higher than the maximum water level during the washing program, such that air can flow to the lower section during the drying program while water is prevented from flowing from the tub (9; 9') to the lower section (57; 57') during the washing program.

2. A washing machine according to claim 1, wherein a lint filter unit (61) is connected to the lower section (57) and is located lower than the maximum water level during the washing program.

3. A washing machine according to claim 1, wherein a blower (19) is connected to the lower section (57) and is located lower than the maximum water level during the washing program.

4. A washing machine according to claim 1 comprising two water level sensors.

5. A washing machine according to claim 1, wherein the chamber is located at a front part of the machine so that air leaves the tub at a front part of the machine.

6. A washing machine according to claim 1, wherein the openings connect at a point that is higher than the maximum water level during the washing program.

7. A washing machine according to claim 1, further comprising a blower configured to move air from the upper section to the lower section.

8. A washing machine according to claim 1, wherein the lower section is configured to convey air to an exterior of the washing machine.

9. A washing machine according to claim 1, further comprising a door allowing access to an interior of the tub, wherein the air evacuation chamber has an outer dimension greater than an outer dimension of the door.

10. A washing machine according to claim 1, further comprising at least one ambient air inlet configured for admitting ambient air to the machine and a heating device configured for heating the ambient air before the air enters the tub.

11. A washing machine with a drying function, capable of performing a washing program and a drying program, comprising a cabinet (1), a tub (9; 9') in the cabinet and a door (3), through which access to the tub interior can be achieved, characterized by an air evacuation chamber (37; 37') which comprises an upper section (59; 59') and a lower section (57; 57'), wherein the upper section (59; 59') is connected to the tub (9; 9') in order to allow an air flow from the tub (9; 9') to the upper section (59; 59'), and the upper section (59; 59') is connected to the lower section (57; 57') at a connection point which is higher than the maximum water level during the washing program, such that air can flow to the lower section during the drying program while water is prevented from flowing from the tub (9; 9') to the lower section (57; 57') during the washing program, wherein the air evacuation chamber (37; 37') is arranged as an annular chamber, surrounding the door (3).

12. A washing machine according to claim 11, wherein the evacuation chamber (37) is defined between a cylindrical wall (39) of the tub (9), a cylindrical collar plate (47) surrounding the door, an inner front wall (43) and an outer front wall (45).

13. A washing machine according to claim 12, wherein the evacuation chamber (37) is divided into the upper section (59) and the lower section (57) by means of side plates (53, 55) attached to and extending sideways and upwards from the collar plate (47), and where openings (49) are provided in the collar plate (47) over the location where the side plates (53, 55) are attached.

* * * * *

UNITED STATES PATENT AND TRADEMARK OFFICE

CERTIFICATE OF CORRECTION

PATENT NO. : 8,516,860 B2
APPLICATION NO. : 12/663313
DATED : August 27, 2013
INVENTOR(S) : Persson et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 900 days.

Signed and Sealed this
Fifteenth Day of September, 2015

Michelle K. Lee

Michelle K. Lee
*Director of the United States Patent and Trademark Office*